US011806560B1

(12) United States Patent
Kalm et al.

(10) Patent No.: US 11,806,560 B1
(45) Date of Patent: Nov. 7, 2023

(54) FIRE SUPPRESSION NOZZLE AND SYSTEM FOR STACKABLE INVENTORY STORAGE MODULES

(71) Applicant: Amazon Technologies, Inc., Seattle, WA (US)

(72) Inventors: William Scott Kalm, Seattle, WA (US); Noah Lael Ryder, Silver Spring, MD (US)

(73) Assignee: Amazon Technologies, Inc., Seattle, WA (US)

( * ) Notice: Subject to any disclaimer, the term of this patent is extended or adjusted under 35 U.S.C. 154(b) by 175 days.

(21) Appl. No.: 15/967,979

(22) Filed: May 1, 2018

(51) Int. Cl.
*A62C 3/00* (2006.01)

(52) U.S. Cl.
CPC ..... *A62C 3/002* (2013.01)

(58) Field of Classification Search
CPC ..... A62C 3/00; A62C 3/004; A62C 3/0214; A62C 35/00; A62C 35/58; A62C 3/0257; A62C 3/0264; A62C 3/002; A62C 31/02; B65G 2207/22; E21F 5/00; B05B 1/267
USPC ..... 169/54, 74, 35
See application file for complete search history.

(56) References Cited

U.S. PATENT DOCUMENTS 1,964,269 A * 6/1934 Munz ..... B05B 15/74 239/521
3,109,593 A * 11/1963 Newland, Sr. ..... B05B 1/267 239/524
3,738,429 A * 6/1973 Heller ..... A62C 3/002 169/56
3,935,896 A * 2/1976 Tegtmeier ..... B05B 1/046 164/486
4,197,914 A * 4/1980 Grey ..... A62C 3/10 114/201 R
4,213,567 A * 7/1980 McIntire ..... A62C 31/02 169/37
5,174,707 A * 12/1992 Suekane ..... A62C 3/00 52/646
5,445,322 A * 8/1995 Formhals ..... G03B 21/608 239/18
5,669,449 A * 9/1997 Polan ..... A62C 37/08 169/16

(Continued)

FOREIGN PATENT DOCUMENTS

JP 08215336 * 8/1996 ..... A62C 31/05

*Primary Examiner* — Christopher R Dandridge
(74) *Attorney, Agent, or Firm* — BakerHostetler

(57) ABSTRACT

In one embodiment, an inventory storage system has at least one storage module and a fire suppression system. The storage module has upper and lower conveyor segments that are configured to move storage containers along a longitudinal direction, and first and second connecting conveyor segments that are disposed at the first and second module ends, respectively. Each connecting segment connects the upper and lower conveyor segments to one another such that the upper and lower conveyor segments and the first and second connecting conveyor segments together define a movement path having a closed shape. The storage module defines a gap between storage containers supported by the upper and lower conveyor segments. The fire suppression system has at least one spray nozzle that is laterally adjacent to the gap and that is configured to spray a liquid extinguishant into the gap and onto storage containers supported by the lower conveyor segment.

22 Claims, 5 Drawing Sheets

(56) References Cited

U.S. PATENT DOCUMENTS

2004/0050956 A1* 3/2004 Ogata ..... B05B 1/265
239/337

* cited by examiner

FIRE SUPPRESSION NOZZLE AND SYSTEM FOR STACKABLE INVENTORY STORAGE MODULES

BACKGROUND

Inventory storage facilities such as warehouses and distribution centers commonly employ shelving units to hold inventory items until they are needed to fulfill a customer order. The shelving units are arranged in rows that are spaced from one another so as to define aisles between the rows of shelving units. To store an inventory item on a desired shelving unit, a human can carry the inventory item down an aisle in the warehouse to the desired shelving unit and place the inventory item on the desired shelving unit where it is stored until it is needed. When an order is placed, a human can travel down the aisle to the desired shelving unit, retrieve the inventory item from the desired shelving unit, and place the inventory item on a conveyor belt that carries the inventory item downstream for packaging and shipping. In some systems, containers are oriented in rows, and the entire row moves up or down vertically under the control of an operator.

BRIEF DESCRIPTION OF THE DRAWINGS

The following detailed description will be better understood when read in conjunction with the appended drawings, in which there is shown in the drawings example embodiments for the purposes of illustration. It should be understood, however, that the present disclosure is not limited to the precise arrangements and instrumentalities shown. In the drawings.

DETAILED DESCRIPTION

In inventory storage facilities, storage density is an important characteristic. Packing inventory items closer together reduces the overall volume that is needed to store the inventory items. Thus, inventory items can be housed in a smaller building or structure when they are packed closer together than when they are packed further apart. Further, packing inventory items closer together (i.e., increasing storage density) in an existing storage facility can free up warehouse space that can be used to store additional inventory items, thereby increasing the capacity of the storage facility. As inventory items are packed closer together, the spacing between the inventory items decreases. This can present difficulties in designing fire protection systems that will be capable of accessing the tiny spaces between inventory items to extinguish fires. Discussed below are spray nozzles that can be used to suppress fires in high-density inventory storage systems. Additionally, discussed below are fire suppression systems having such spray nozzles, and inventory storage systems having such fire suppressions systems.

Figures 1A, 1B:
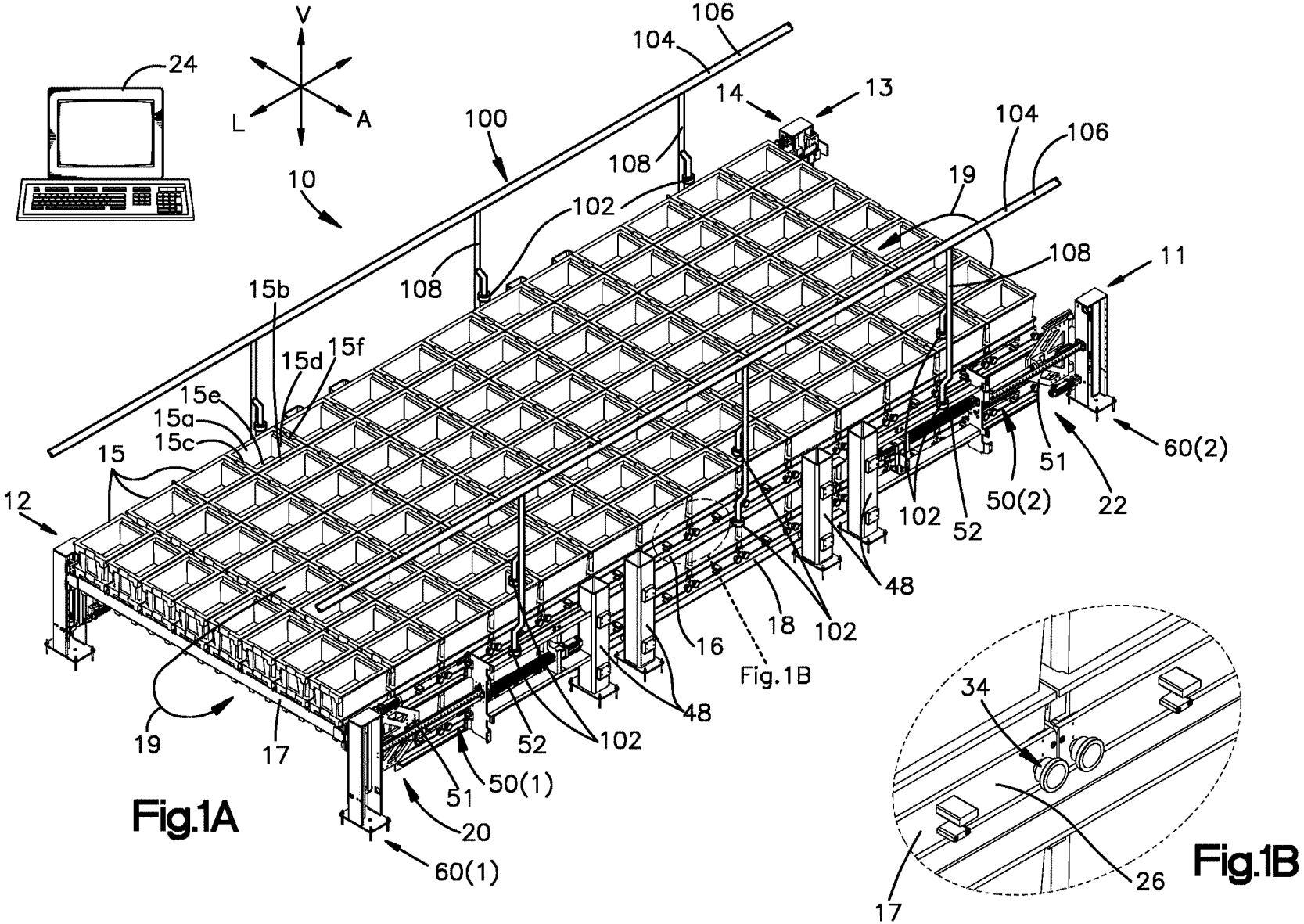
FIG. 1A shows a perspective view of an inventory storage system according to one embodiment having a storage module and a fire suppression system, where the storage module supports a plurality of inventory storage containers.
FIG. 1B shows an enlarged view of a portion of the storage system of FIG. 1A.
Figure 2A:
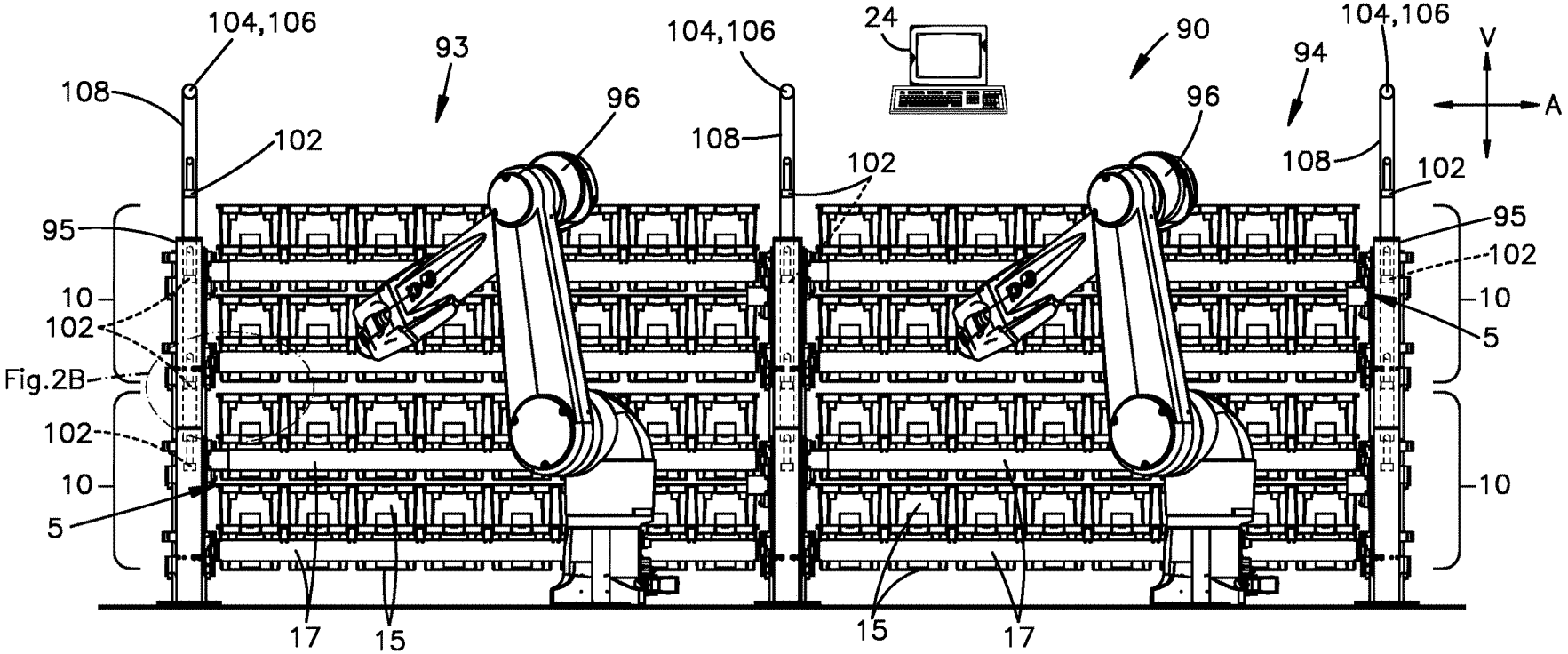
FIG. 2A shows an end view of a storage system according to one embodiment that comprises a plurality of instances of the storage module of FIG. 1A and a fire suppression system.

Referring to FIGS. 1A and 2A, an inventory storage system comprises at least one storage module 10 and a fire suppression system 100. Each storage module 10 is configured to store inventory items, and the fire suppression system 100 is configured to spray a liquid fire extinguishant, such as water or a chemical fire retardant, into at least a portion of the storage system and onto the inventory items. In FIG. 1A, a system is shown having a single storage module 10, while in FIG. 2A, a system is shown having a plurality of vertical stacks of storage modules 10 (e.g., two), where each vertical stack includes a plurality of storage modules 10 (e.g., two) stacked over one another. Each storage module 10 can be configured as any one of the storage modules described in PCT patent application no. PCT/US2018/013920, filed on Jan. 16, 2018, the teachings of all of which are hereby incorporated by reference as if set forth in their entirety herein. However, for ease of discussion, the present invention will be described relative to its use with the storage module shown in FIGS. 1-10 of PCT/US2018/013920.

In general, each inventory storage module 10 has a first module end 12 and a second module end 14 spaced from one another along a longitudinal direction L. Each storage module 10 also has a first module side 11 and a second module side 13 spaced from one another along a lateral direction A, perpendicular to the longitudinal direction L. The longitudinal direction L can be a first horizontal direction, and the lateral direction A can be a second horizontal direction.

Each storage module 10 is elongate from its first module end 12 to its second module end 14 along the longitudinal direction L. For example, each storage module 10 has a module length along the longitudinal direction L from its first module end 12 to its second module end 14 that is greater than a module width of the storage module 10 from its first module side 11 to its second module side 13 along the lateral direction A. The module length can also be greater than a module height along a vertical direction V, perpendicular to both the longitudinal direction L and the lateral direction A. In some embodiments, the module width can be greater than the module height. The overall dimensions (e.g., module length, module width, and module height) of each storage module 10 may be selected to optimize storage density of the stackable storage module 10 or other suitable parameter. For example, the dimensions may be selected to fit within a particular structure (e.g., a shipping container or warehouse).

As will be described in further detail below, each storage module 10 has an upper level and a lower level that are spaced from one another along a vertical direction V. Each of the upper and lower levels are configured to support storage containers 15 that are in turn configured to store inventory items therein. The storage containers 15 supported by the upper level are spaced from the storage containers 15 supported by the lower level so as to define a gap 5 therebetween. Each gap 5 may be referred to as a module gap. Further, in systems in which a plurality of the storage modules 10 are stacked over one another, such as shown in FIG. 2A, the storage modules 10 in each stack are spaced from one another so as to define a gap 7 between adjacent ones of the storage modules 10 in the stack. For example, each gap 7 is defined between the storage containers 15 supported by the lower level of a select one of the storage modules 10 in the stack and the storage containers 15 supported by the upper level of a storage module 10 immediately below the select one of the storage modules 10. Each gap 7 may be referred to herein as a system gap.

The fire suppression system 100 comprises at least one spray nozzle 102, such as a plurality of spray nozzles 102. Each spray nozzle 102 is positioned adjacent to a gap 5 or 7 with respect to the lateral direction A such that the spray nozzle 102 is configured to spray the liquid extinguishant into the gap 5 or 7 and onto storage containers below the gap. Stated differently, each spray nozzle 102 can be in-line with a gap 5 or 7 along the lateral direction A. The fire suppression system 100 also comprises supply piping 104 that provides the liquid extinguishant to each spray nozzle 102 and that supports each spray nozzle 102 at its position adjacent a respective one of the gaps. The supply piping 104 can include at least one feed line 106 and at least one branch line 108. For example, each feed line 106 can supply a plurality of branch lines 108, and each branch line 108 can supply at least one spray nozzle 102, such as a plurality of spray nozzles 102. In some examples, the fire suppression system 100 can be configured to supply liquid extinguishant to the at least one spray nozzle 102 at a pressure between approximately 35 psi and approximately 70 psi, such as between approximately 50 psi and approximately 60 psi.

The fire suppression system 100 can include at least one valve (not shown) positioned upstream of the at least one spray nozzle 102. The at least one valve can be controlled via a fire control system and is configured to prevent liquid extinguishant from flowing to the at least one spray nozzle 102 until at least one of smoke, heat, and a flame is detected by the fire control system. The fire suppression system 100 can have as few as a single valve for the entire fire suppression system 100 (i.e., for all of the spray nozzles 102) or up to one valve for each spray nozzle 102. In the former case, the single valve can be positioned along the feed line 106 before all of the branch lines 108. In the latter case, each valve can be positioned along a branch line 108 just before one of the spray nozzles 102. In a preferred embodiment, the fire suppression system 100 can include a plurality of valves, each for a subset of the spray nozzles 102. For example, the fire suppression system 100 can include one valve for each branch line 108 that is configured to prevent liquid extinguishant from flowing to the spray nozzles 102 of the branch line 108 until at least one of smoke, heat, and a flame is detected.

Turning now more specifically to the details of the storage modules 10 and with reference to FIG. 1A, each storage module 10 has a plurality of conveyor segments that define a movement path 19. The movement path 19 can be defined in a plane that extends along the vertical direction V and the longitudinal direction L. The movement path 19 can have a closed shape, such as a rectangle, a loop, an oval, or any other suitable closed and preferably convex shape. Each storage module 10 is configured to move storage containers along its movement path 19. For example, each storage module 10 has an upper conveyor segment 16 and a lower conveyor segment 18 that are spaced from one another along the vertical direction V, and that extend along the longitudinal direction L. The upper and lower conveyor segments 16 and 18 define the upper and lower levels, respectively, discussed above. The module height can be defined from the first conveyor segment 16 to the second conveyor segment 18. Each storage module also has a first connecting conveyor segment 20 adjacent the first module end 12 and a second connecting conveyor segment 22 adjacent the second module end 14. Each of the upper and lower conveyor segments 16 and 18 are configured to move inventory storage containers 15 along the longitudinal direction L between the first and second connecting conveyor segments 20 and 22. Thus, the upper and lower conveyor segments 16 and 18 can be considered to be longitudinal conveyor segments.

The first and second conveyor segments 16 and 18 extend between the first module end 12 and the second module end 14, and between the first module side 11 and the second module side 13. The first and second conveyor segments 16 and 18 are each elongate along the longitudinal direction L. For example, each of the first and second conveyor segments 16 and 18 has a segment length along the longitudinal direction L and a segment width along the lateral direction A, where the segment length is greater than the segment width. Each of the longitudinal conveyor segments 16 and 18 can include a conveyor surface, and the storage module 10 can be configured to move storage containers 15 along the conveyor surfaces along the longitudinal direction L. In some embodiments, each of the conveyor segments 16 and 18 can be configured to move container carriers 17, where each container carrier supports at least one storage container 15 as described below. The conveyor surfaces can be defined by conveyor elements such as tracks, belts, rollers, skate wheels, balls, any other suitable conveyor elements for translating the storage containers 15, or any suitable combination of conveyor elements.

The storage module 10 can include one or more supports that couple the upper and lower conveyor segments 16 and 18 to one another. For instance, the storage module 10 can include one or more supports, such as one or more posts 48, that are coupled to the upper conveyor segment 16 and the lower conveyor segment 18 so as to position the upper conveyor segment 16 above the lower conveyor segment 18. The posts 48 can be disposed at one or both of the first and second module sides 11 and 13.

The first and second connecting conveyor segments 20 and 22 are offset from one another along the longitudinal direction L. Each of the first and second connecting conveyor segments 20 and 22 connect the upper and lower conveyor segments 16 and 18 to one another. Thus, each of the first and second connecting conveyor segments 20 and 22 are configured to move inventory items, which can be stored in the storage containers 15, between the upper and lower conveyor segments 16 and 18. For example, each of the first and second connecting conveyor segments 20 and 22 can be configured to move storage containers 15 along the vertical direction V from one of the upper and lower conveyor segments 16 and 18 to the other one of the upper and lower conveyor segments 16 and 18. In some embodiments, each of the first and second connecting conveyor segments 20 and 22 can be implemented as a vertical lift as described in relation to the any one of the vertical lifts described in PCT/US2018/013920 that is configured to transfer the storage containers 15 along the vertical direction V between the upper and lower conveyor segments 16 and 18. Thus, the upper and lower conveyor segments 16 and 18 can each define a discontinuous conveyor segment, and the vertical lifts 60(1) and 60(2) can transfer the storage containers 15 between the discontinuous conveyor segments. The storage module 10 can be configured such that, when the vertical lifts 60(1) and 60(2) transfer container carriers 17, at least some, up to all, of the container carriers 17 on the upper and lower conveyor segments 16 and 18 remain stationary. The storage module 10 can be configured such that, when the container carriers 17 are moved along the upper and lower conveyor segments 16 and 18, the vertical lifts 60(1) and 60(2) do not move any container carriers 17. In other embodiments (e.g., as shown in FIGS. 11-21 and 24-31 of PCT/US2018/013920), the first and second connecting conveyor segments 20 and 22 can include conveyor surfaces such as (without limitation) tracks that connect the first and second conveyor segments 16 and 18. Thus, in such embodiments, the conveyor segments 16, 18, 20, and 22 together can define a continuous conveying surface or track.

The conveyor segments 16, 18, 20, and 22 together define the movement path 19. The movement path 19 can be elongate along the longitudinal direction L. The movement path 19 can be considered to be a closed movement path in that that conveyor segments 16, 18, 20, and 22 transfer storage containers 15 only around the movement path 19, without transferring storage containers 15 outside of the movement path 19. However, it will be understood that the storage containers 15 can be removed from, and placed back into, the movement path 19 by a person or machine such as a robotic arm.

Each storage module 10 can include one or more movement systems (e.g., 50(1), 50(2)) that are configured to move the inventory storage containers 15 along the movement path 19. In one embodiment, each movement system can include a catch 52 that is coupled to an actuator 51 as described in PCT/US2018/013920, or can be configured as another one of the movement systems described therein. The catch 52 can be configured to engage at least one of a container carrier 17 and a storage container 15 so as to push or pull the at least one of the container carrier 17 and a storage container 15 along the movement path 19. The actuator 51 can be configured to move the catch 52 back and forth along the longitudinal direction L so as to push or pull the at least one of the container carrier 17 and a storage container 15. The movement systems and conveyor segments 16, 18, 20, and 22 operate together to move the storage containers 15 around the movement path 19 until a desired one of the storage containers 15 is presented at one of the first module end 12 and the second module end 14. At such position, the desired storage container 15 can be accessed by a person, or machine such as a robotic arm, so that an inventory item can then be placed onto the desired storage container 15 for storage or can be removed from the desired storage container 15 to fulfill a customer order or for further transporting or processing. Additionally or alternatively, the person or machine can remove storage containers 15 from the storage module and place storage containers 15 onto the storage module.

Each storage module can operate in a unidirectional manner such the storage containers 15 can be moved in only a first direction (that is, clockwise or counterclockwise) around the movement path. Alternatively, each storage module can operate in a bidirectional manner such the storage containers 15 can be selectively rotated in one of the first direction and a second direction, opposite the first direction. The movement and positioning of storage containers 15 can be controlled by a controller 24, which can be in wired or wireless communication with the segments of the storage module. The controller 24 can control the speed and optionally the direction in which the storage containers are translated. Further, the controller 24 can stop movement of the storage containers when a desired storage container is presented at one of the first and second ends 12 and 14.

Each storage container 15 can be any suitable storage container configured to carry one or more inventory items therein. Preferably, the inventory storage containers 15 are open-top plastic totes configured to carry items in an e-commerce supply chain. The totes are of a size that an individual person or robot can lift. For example, and with reference to FIG. 1A, each storage container 15 can be a rectangular structure, such as a bin or tote, formed from a rigid material such as high-density plastic, wood, aluminum, or other suitable material. Each storage container 15 can have a pair of opposed container sidewalls 15*a* and 15*b* that are spaced opposite from one another. Each storage container 15 can have a pair of opposed container end walls 15*c* and 15*d* that are spaced opposite from one another. The opposed container end walls 15*c* and 15*d* can extend between the opposed container sidewalls 15*a* and 15*b*. Similarly, the opposed container sidewalls 15*a* and 15*b* can extend between the opposed container end walls 15*c* and 15*d*.

Each container 15 has a width Ws from one of the sidewalls 15*a* and 15*b* to the other one of the sidewalls 15*a* and 15*b*, and can have a length Ls from one of the end walls 15*c* and 15*d* to the other one of the end walls 15*c* and 15*d*. In some embodiments, the length Ls can be greater than the width Ws. Each storage container 15 can further have an upper end 15*e* and a bottom surface 15*f* spaced from one another along the vertical direction V. The bottom surface 15*f* can extend between the opposed sidewalls 15*a* and 15*b* and between the opposed end walls 15*c* and 15*d*. The upper end 15*e* can be open for ease of access in placing inventory items into, and retrieving inventory items from, the storage container 15. Each container 15 can have a height Hs from the upper end 15*e* to the bottom surface 15*f*.

The size of a storage container 15 may be selected to optimize storage density of the stackable storage module or other suitable parameter. This may depend on the size and type of items to be stored in the storage container 15. For example, the storage container 15 may have a height of about 18", a width of about 18", and a length of about 24". However, the dimensions of the storage container 15 can be different than those just recited. The items held by the storage container 15 can be any suitable item stored in a material storage facility including, for example, personal electronic devices, computers, recreational equipment, food products, television sets, clothing, household supplies, automotive parts, books, loaded pallets, and any other suitable object capable of being stored.

The storage containers 15 can be stackable on top of one another. For example, the bottom surface 15*f* of an upper one of the storage containers 15 can be received in the opening of the upper end 15*e* of a lower one of the storage containers 15. The upper end 15*e* of the lower storage container 15 can be configured to support the bottom surface 15*f* of the upper storage container 15 such that the bottom surface 15*f* of the upper storage container 15 nests inside the opening of the lower storage container 15. Each container 15 can also include at least one protrusion 15*g*, each extending outwardly from at least one of the container sidewalls and end walls. For example, each container 15 can include a plurality of protrusions 15*g*, each extending outwardly from at least one of the sidewalls and end walls at a corner of the container 15 adjacent the upper end 15*e*. At least one protrusion 15*g* can define a handle that is configured to be configured to be engaged by a human hand for carrying. At least one protrusion 15*g* can include a lower surface that is configured to be engaged by a tine of an end effector of a robotic arm (shown in FIG. 2A), fork lift, or other lifting machine. For example, a storage container 15 can include a pair of the protrusions 15*g* disposed on opposite sides or ends of the container 15 that are configured to engage a pair of tines of an end effector.

Each storage container 15 may include an identifier (e.g., bar code, QR code, radio-frequency identification (RFID) tag, and any other suitable identifier). The identifier may be used to uniquely identify the storage container 15. In some examples, the identifier may include non-volatile data storage, which may be associated with the storage container 15 and/or its contents. Data can be read/written to the data storage each time the stackable storage module is accessed. This data may contain status of the stackable storage module, inventory stowed in the stackable storage module, and/or destination information for each storage container 15. In this manner, inventory information may be updated when the identifiers are read.

In some embodiments, as shown in FIGS. 1A and 2A, the storage module can include a plurality of container carriers 17, where each container carrier 17 is configured to support at least one of the inventory storage containers 15. Each container carrier 17 can be configured as described in relation to any one of the container carriers 17 described in PCT/US2018/013920. In such embodiments, the conveyor segments 16, 18, 20, and 22 can be configured to transfer the container carriers 17 around the movement path 19 until a desired one of the container carriers 17 is presented at one of the first and second module ends 12 and 14. Thus, the upper and lower conveyor segments 16 and 18 can be configured to transfer the carriers 17 along the longitudinal direction L, and the first and second conveyor segments 20 and 22 can be configured to transfer container carriers 17 between the upper and lower conveyor segments 16 and 18.

Each container carrier 17 can have a carrier body 26 that is configured to support at least one storage container 15. For example, each carrier body 26 can have a length along the lateral direction A that is sized to support a row of storage containers 15 that extends along the lateral direction A. Thus, the carrier body 26 can support a plurality of storage containers 15 side-by-side or end-to-end along the lateral direction A. Each container carrier 17 can include at least one conveyor-segment engagement feature that is configured to engage the conveyor segments 16, 18, 20, and 22 so that the container carrier 17 can be translated around the movement path 19. In some embodiments, the at least one conveyor-segment engagement feature can include at least one pair of wheel assemblies, where the wheels 34 of the pair are spaced from one another along the lateral direction A, or two pairs of wheel assemblies, where the pairs of wheels are spaced from one another along the longitudinal direction L. However, it will be understood that, in alternative embodiments, the at least one conveyor segment engagement feature can include a feature other than a wheel assembly. For example, each conveyor-segment engagement feature can be a rod or pin that engages a bearing or chain of tracks of the conveyor segments 16, 18, 20, and 22.

In at least some examples, the container carrier 17 can include an identifier. The identifiers may be used to identify a position of the container carrier 17 (and the storage container 15) with respect to the stackable storage module. In some examples, the stackable storage module (or system in which the stackable storage module is implemented) may include any suitable combination of encoders, RFID readers and antenna, cameras, and/or other sensing devices for identifying and locating the container carriers 17 and/or the storage containers 15.

Each storage module 10 can include one or more sensors to provide sensor data that can be used to manage the operation of the stackable storage module. For example, a position sensor may be used to detect positions of the container carriers 17 and/or storage containers 15. As an additional example, an optical scanner may be used to scan the identifier. Other sensors relating to control of the movement system may also be provided. In some examples, other sensors are provided to detect when items protrude out of the storage containers 15 in a way that could be problematic. For example, because the tolerances between modules or between levels of a module may be very tight, it may be desirable that items do not extend beyond a top of the storage containers 15.

Referring to FIG. 2A, each storage module 10 can be modular in the sense that each storage module 10 can be fully functional on its own, and multiple instances of the storage modules 10 can be grouped together in clusters (e.g., a group of more than one stackable storage module). When grouped into clusters, each stackable storage module 10 can remain independently controllable by the item movement management system. A cluster of stackable storage modules 10 can be assembled in a fixed structure (e.g., in a warehouse to augment or replace vertical shelving units or other conventional storage means), in a mobile structure (e.g., a shipping container), and in other mobile and non-mobile arrangements. Use of clusters of stackable storage modules 10 may enable increased flexibility with item storage.

A plurality of instances of each storage module 10 can be arranged in a cluster of storage modules 10 in a modular storage and retrieval system as shown in FIG. 2A. The system can include at least one vertical stack of the storage modules 10, where each vertical stack comprises at least two storage modules 10 stacked on top of one another along the vertical direction V. In some embodiments, each modular storage and retrieval system can include a plurality of the vertical stacks 93 and 94 of storage modules 10 that are offset from one another along the lateral direction A. Although two vertical stacks 93 and 94, each having two storage modules 10 are shown, it will be understood that the number of vertical stacks and the number of storage modules 10 in each vertical stack can vary from that shown. In particular, modular storage and retrieval systems of the disclosure can include at least one vertical stack of storage modules 10 or more than one vertical stack of storage modules 10. Further, each vertical stack of storage modules 10 can have at least two storage modules 10 stacked on top of one another or more than two storage modules 10. Thus, height, width, and length of the system can be scalable to fit within a desired volume in a warehouse space.

The storage modules 10 can be independently operated such that the storage containers 15 of each storage module 10 can be driven around its corresponding movement path 19 independently of the storage containers 15 of other storage modules being driven around their corresponding movement paths. Thus, the movement paths 19 of each storage module 10 can be independent from and unconnected to the movement paths 19 of the other storage modules 10.

The modular storage and retrieval storage system can include supports 95 that are coupled to the conveyor segments in each storage module 10 in each vertical stack 93 and 94 so as to maintain the storage modules 10 in a stacked relation. The supports 95 can further be coupled to laterally adjacent storage modules 10 so as to attach the vertical stacks 93 and 94 of storage modules 10 to one another. The supports 95 can combine to form a frame of the system. Note that each support 95 can be formed by coupling or fastening the corresponding supports (see e.g., 48 in FIG. 1A) of vertically stacked storage modules 10 to one another, or by making the corresponding supports integral to one another.

Each modular storage and retrieval system can include a robotic manipulator 96 that is configured to retrieve inventory items from the storage containers 15 and/or remove the storage containers 15 from the storage module. Each robotic manipulator 96 can also be configured to place inventory items into the storage containers 15 and/or place storage containers 15 onto the storage module 10. Each robotic manipulator 96 may be any suitable material handling robot (e.g., Cartesian robot, cylindrical robot, spherical robot, articulated robot, parallel robot, SCARA robot, anthropomorphic robot, any other suitable robotic manipulator and/or robotic arm, automated guided vehicles including lift capabilities, vertical lift modules, and any other suitable material handling equipment that interacts with or otherwise handles objects). The robotic manipulator may include any suitable type and number of sensors disposed throughout the robotic manipulator (e.g., sensors in the base, in the arm, in joints in the arm, in an end effector, or in any other suitable location). The sensors can include sensors configured to detect pressure, force, weight, light, objects, slippage, and any other information that may be used to control and/or monitor the operation of the robotic manipulator, including an end effector.

The storage containers 15 in the storage module 10 can be densely packed along the longitudinal direction L. For example, the storage containers 15 can be supported by the container carriers 17 along the upper and lower conveyor segments 16 and 18 such that the storage containers 15 are densely packed along the upper and lower conveyor segments 16 and 18 along the longitudinal direction L. The container carriers 17 carried by each of the upper and lower conveyor segments 16 and 18 can be arranged end-to-end such that there is little to no space between storage containers 15 of adjacent ones of the container carriers 17. In some embodiments, container carriers 17 and/or storage containers 15 along each conveyor segment may contact one another other. In other embodiments, the storage containers 15 supported by adjacent container carriers 17 may be spaced from each other by a distance that is no more than 10 percent of the overall length or width of each storage container 15 along the longitudinal direction L or no more than 5 percent of the overall length or width of each storage container 15 along the longitudinal direction L. As each container carrier 17 is moved from one of the first and second conveyor segments 16 and 18 to the other, the container carrier 17 can be separated from the container carriers 17 supported by the first and second conveyor segments 16 and 18, thereby avoiding collisions between the moving container carrier 17 and the container carriers 17 supported by the first and second conveyor segments 16 and 18. As a result, the storage containers 15 supported by the first and second conveyor segments 16 and 18 can be spaced closer to one another than in comparable carousel systems where all of the storage units are rotated concurrently.

The storage containers 15 supported by each container carrier 17 can be densely packed along the lateral direction A. For example, the storage containers 15 carried by each container carrier 17 can be arranged side-to-side (or end-to-end) such that there is little to no space between adjacent ones of the storage containers 15. In some embodiments, storage containers 15 supported by each container carrier 17 may contact one another other. In other embodiments, the storage containers 15 may be spaced from each other by a distance that is no more than 10 percent of the overall width of each storage container 15 or no more than 5 percent of the overall width of each storage container 15.

The storage containers 15 in the storage module 10 can be densely packed along the vertical direction V. In particular, the storage containers 15 on the upper conveyor segment 16 can be stacked above the storage containers 15 on the lower conveyor segment 18 so that the gap 5 between the storage containers 15 on upper and lower conveyor segments 16 and 18 can be minimized to maximize storage density. In some examples, the height H of this gap 5 can be described by absolute distance, such as a distance ranging from 0.25 inches to 5.0 inches, such as 1.0 inches to 3.0 inches. In one example, the height H is about 2.0 inches. In other examples, the height H of this gap 5 can be described in relation to a height of one of the storage containers 15, such as a spacing that is no more than 20 percent of the height of the storage containers 15, such as no more than 15 percent of the height of the storage containers 15, such as no more than 10 percent of the height of the storage containers 15, or such as no more than 5 percent of the height of the storage containers 15. Storage density is inversely proportional to the height H of the gap 5 between the storage containers 15. Thus, as this height H is decreased, the storage density increases.

Figure 2B:
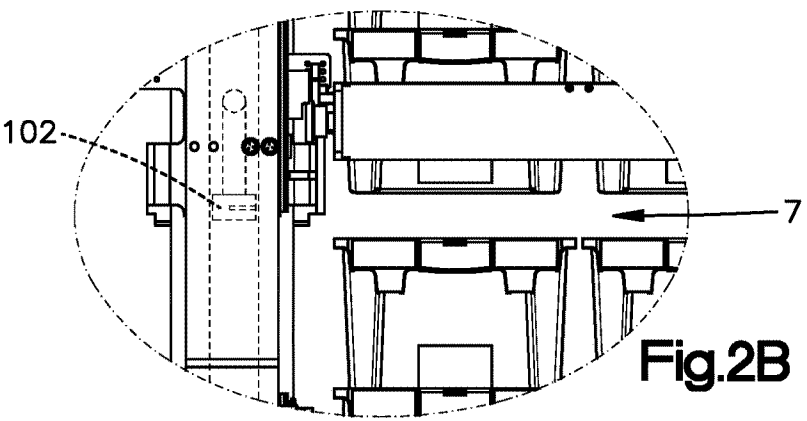
FIG. 2B shows an enlarged view of a portion of the storage system of FIG. 2A, showing a gap between storage modules.
Figure 3:
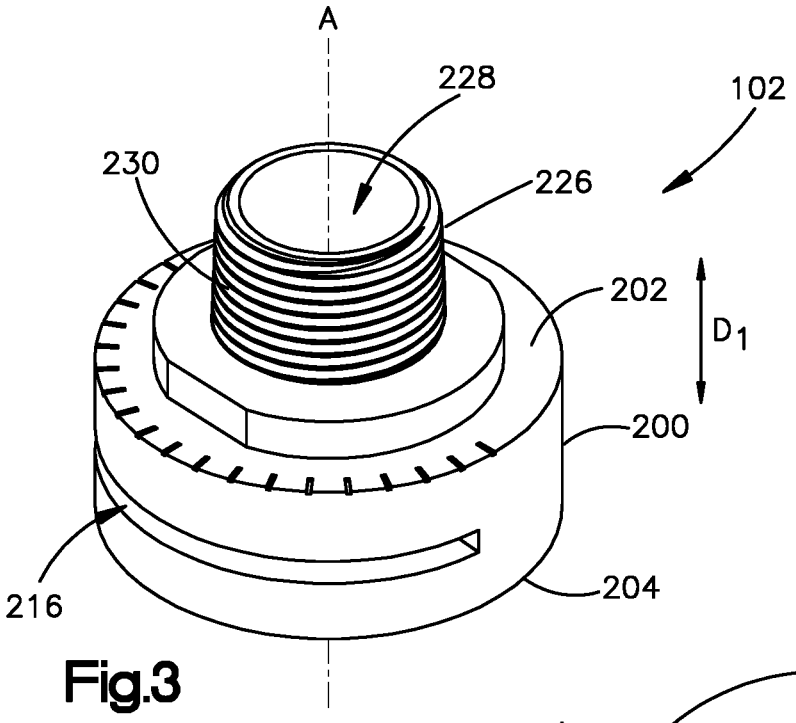
FIG. 3 shows a perspective view of a spray nozzle of the fire suppressions of FIGS. 1A and 2A according to one embodiment.
Figure 4:
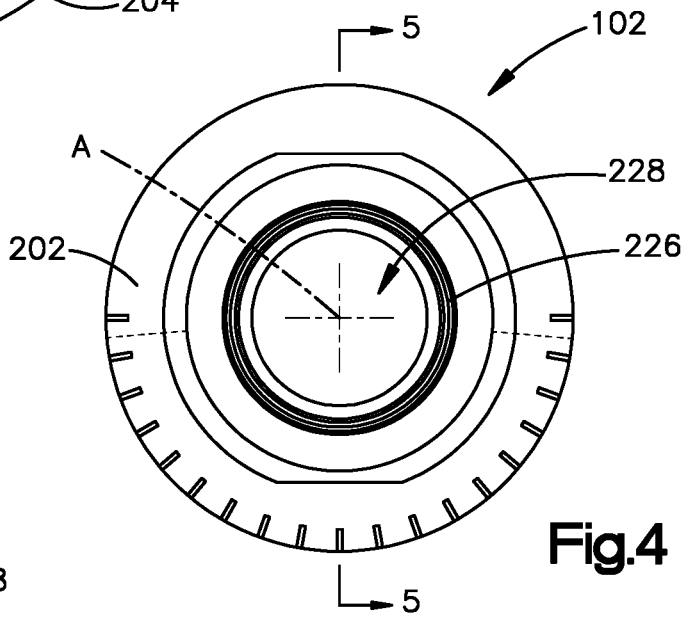
FIG. 4 shows a top plan view of the spray nozzle of FIG. 3.
Figure 5:
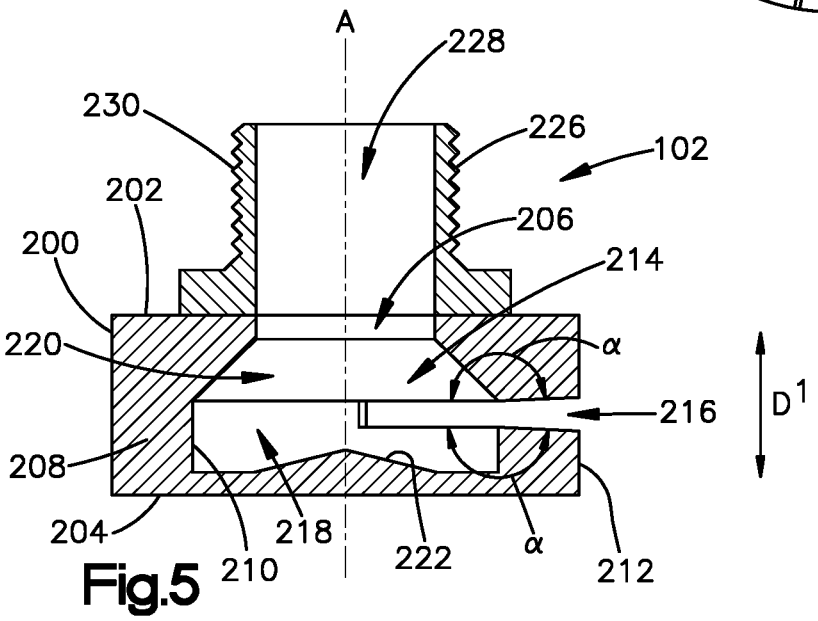
FIG. 5 shows a cross-sectional side view of the spray nozzle of FIG. 3 taken at line 5-5.
Figure 6:
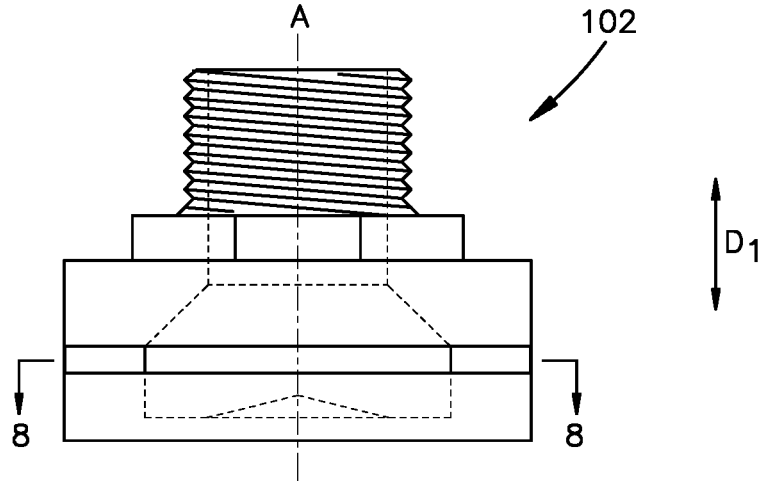
FIG. 6 shows a front plan view of the spray nozzle of FIG. 3.
Figure 7:
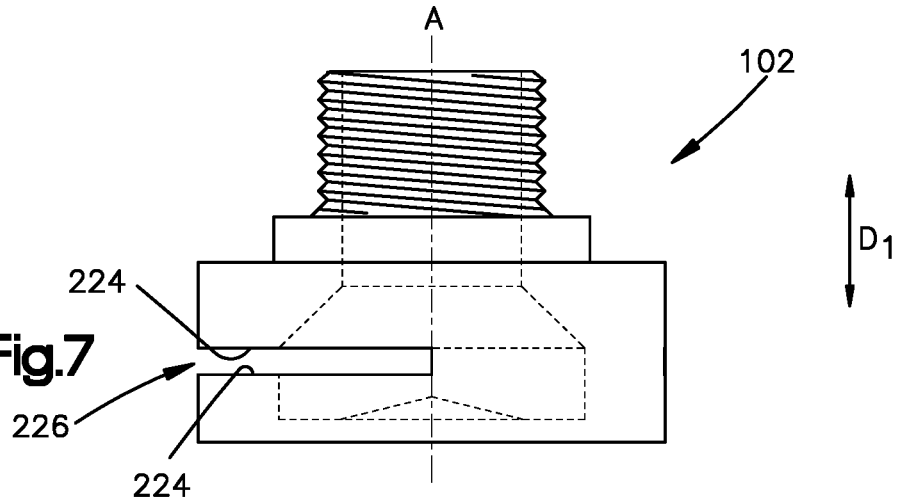
FIG. 7 shows a side plan view of the spray nozzle of FIG. 3.
Figure 8:
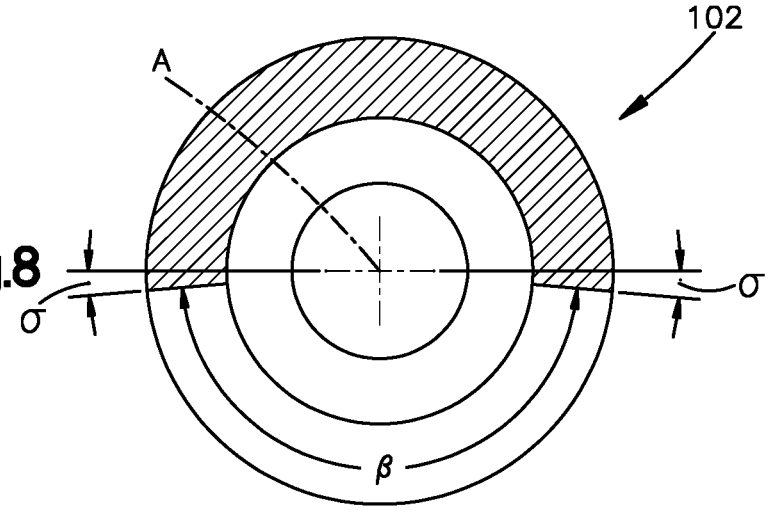
FIG. 8 shows a cross-sectional top view of the spray nozzle of FIG. 3 taken at line 8-8.

Further, in systems in which a plurality of the storage modules 10 are stacked over one another, such as shown in FIGS. 2A and 2B, the storage modules 10 in each stack can be densely packed along the vertical direction. In particular, the gap 7 between adjacent ones of the storage modules 10 in the stack can have a height H that is defined between the storage containers 15 supported by the lower level of a select one of the storage modules 10 in the stack and the storage containers 15 supported by the upper level of a storage module 10 immediately below the select one of the storage modules 10. The height H of this gap 7 can be described by absolute distance, such as a distance ranging from 0.25 inches to 6.0 inches, such as 2.0 inches to 4.0 inches. In one example, the height H is about 2.0 inches. In other examples, the height H of this gap 7 can be described in relation to a height of one of the storage containers 15, such as a spacing that is no more than 20 percent of the height of the storage containers 15, such as no more than 15 percent of the height of the storage containers 15, such as no more than 10 percent of the height of the storage containers, or such as no more than 5 percent of the height of the storage containers 15. Storage density is inversely proportional to the height H of the gap 7 between the storage modules 10. Thus, as this height H is decreased, the storage density increases.

Turning now more specifically to the details of the fire suppression system 100, and with reference to FIGS. 1A, 1B, 2A, and 2B, the fire suppression system 100 comprises at least one spray nozzle 102, such as a plurality of spray nozzles 102. Each spray nozzle 102 is disposed adjacent to one of the vertical gaps between the storage containers 15 with respect to the lateral direction L. Stated differently, each spray nozzle 102 is in-line with a respective one of the vertical gaps along the lateral direction A. Further, each spray nozzle 102 is configured to spray a liquid extinguishant into the corresponding gap 5 and onto storage containers 15 disposed below the gap 5. For example, as described above, each storage module 10 defines a gap 5 between storage containers 15 supported by the upper conveyor segment 16 and storage containers 15 supported by the lower conveyor segment 18. At least one spray nozzle 102 can be disposed adjacent to the gap 5 with respect to the lateral direction A, and the spray nozzle 102 can be configured to spray a liquid extinguishant into the gap 5 and onto storage containers 15 supported below the gap 5. As another example, the storage modules 10 in a vertical stack can be spaced from one another so as to define a gap 7 between adjacent ones of the storage modules 10 in the stack. At least one spray nozzle 102 can be disposed adjacent to the gap 7 with respect to the lateral direction A, and the spray nozzle 102 can be configured to spray a liquid extinguishant into the gap 7 between the storage modules 10 and onto storage containers 15 supported below the gap 7.

Figure 9:
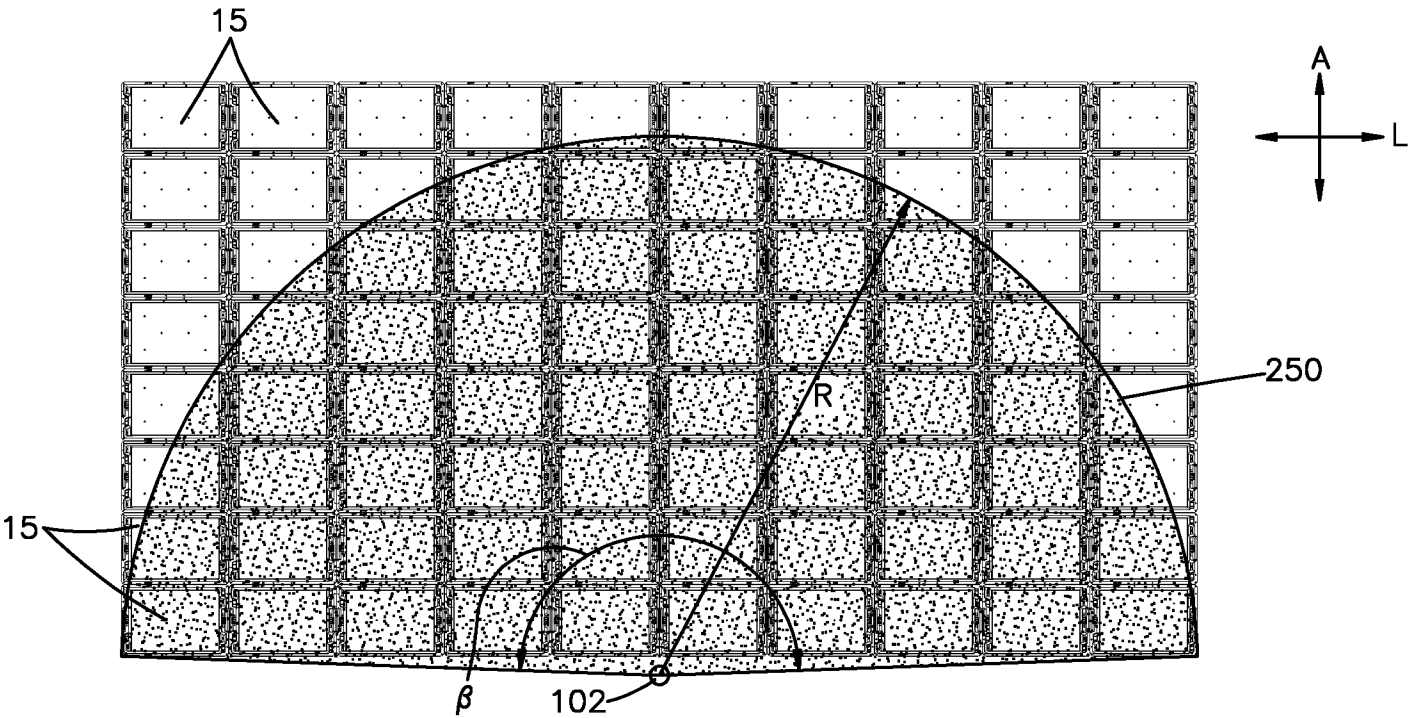
FIG. 9 shows a top plan view of a plurality of storage containers of a storage module of FIGS. 1A and 2A with a spray pattern of the spray nozzle of FIG. 3 superimposed thereover according to one embodiment.

Referring to FIG. 9, each spray nozzle 102 can be configured to spray the liquid extinguishant in a pattern 250 that is at least partially circular. In one example, each spray nozzle 102 can be configured to spray the liquid extinguishant in a substantially semi-circular pattern 250 or in a partially-circular pattern having a shape that is a sector of a circle, the sector having a central angle β The central angle β can be less than or equal to 180 degrees. Thus, the sector can be a minor sector. Each spray nozzle 102 can be configured to discharge the liquid extinguishant in a spray pattern 250 that has a radius R that is large enough to cover an area that includes a plurality of storage containers 15 along the lateral direction A and a plurality of storage containers 15 along the longitudinal direction L. In some embodiments, the radius R can be between seven feet and sixteen feet, including every one-inch increment therebetween. In a preferred embodiment, the radius R can be approximately eleven feet.

Figure 10:
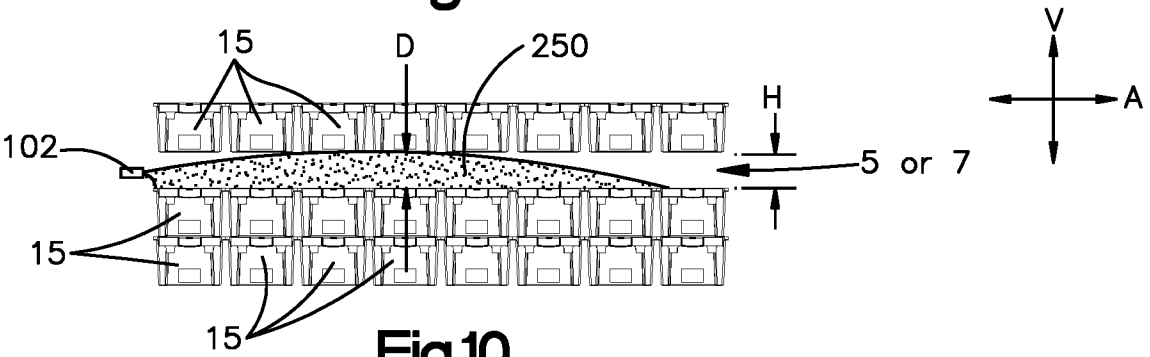
FIG. 10 shows an end plan view of a plurality of storage containers of the storage modules of FIGS. 1A and 2A with the spray pattern of FIG. 8 superimposed therebetween.

Referring to FIG. 10, each spray nozzle 102 is preferably configured such that it can cover the storage containers 15 within its entire spray pattern 250 substantially evenly. Thus, each spray nozzle 102 is preferably configured such that storage containers 15 that are adjacent the center of the spray pattern 250 (i.e., closest to the spray nozzle 102) receive an amount of liquid extinguishant that is substantially equal to that received by storage containers 15 that are at the outer perimeter of the spray pattern 250 (i.e., furthest from the spray nozzle 102 yet still within the nozzle's spray pattern 250). To accomplish this within gaps 5 and 7, each spray nozzle 102 can be configured to discharge its spray pattern 250 such that the liquid extinguishant at the outer perimeter of the spray pattern 250 does not drop below the outlet of the spray nozzle 102 by a distance that is greater than the height H of the gap 5 or 7. Thus, the spray pattern 250 can have a vertical drop D that is measured along the vertical direction V from the highest point of the spray pattern 250 to a point where the spray pattern 250 contacts a top of one of the storage containers 15, and the vertical drop D can be less than or equal to the gap height H. In one example, each spray nozzle 102 is configured to discharge a spray pattern 250 having a radius R of approximately eleven feet with a vertical drop D that is no greater than approximately 1.6 inches, when receiving the liquid extinguishant at a pressure of between approximately 50 psi and approximately 60 psi. In this example, the spray velocity can be approximately 78 ft/s.

Referring back to FIGS. 1A and 2A, to adequately cover the storage containers 15 in each storage module 10, the fire suppression system 100 can comprise a plurality of the spray nozzles 102. The spray nozzles 102 can be disposed on opposed module sides 11 and 13 of the storage module 10 such that they are configured to spray into the storage module 10 from the opposed module sides 11 and 13. In this manner, the spray nozzles 102 at the opposed module sides 11 and 13 can work together such that the spray from the opposed spray nozzles 102 cover the full width of the storage module 10 along the lateral direction A. Note that although each spray nozzle 102 is shown in FIG. 1A as being aligned with another spray nozzle 102 along the lateral direction A, embodiments of the disclosure are not so limited. In alternative embodiments, the spray nozzles 102 can be staggered such that they are not aligned along the lateral direction A. For instance, a spray nozzle 102 disposed at one of the module sides 11 and 13 can be aligned along the lateral direction A with a point that is between two spray nozzles 102 disposed at the other one of the module sides 11 and 13. Further, in alternative embodiments, each spray nozzle 102 can be configured to cover the full width of the storage module 10, without the need for an opposing spray nozzle 102 on the opposite module side 11 or 13.

The spray nozzles 102 can be arranged in rows that extend along the longitudinal direction L. In particular, the spray nozzles 102 in each row can be spaced from one another along the longitudinal direction L, and each row can be aligned with one of the gaps 5 or 7 with respect to the lateral direction A. In this manner, the spray nozzles 102 in each row can work together such that the spray from the row of spray nozzles 102 cover the full length of the storage module 10 along the longitudinal direction L. For example, in FIG. 1A, two rows of spray nozzles 102 are shown at the first module side 11, where the two rows are spaced from one another along the vertical direction V. The lower row of spray nozzles 102 is positioned such that the spray from its spray nozzles 102 is discharged into the gap 5 between the upper and lower conveyor segments 16 and 18 and onto the storage containers 15 supported by the lower conveyor segment 18. The upper row of spray nozzles 102 is positioned such that the spray from its spray nozzles 102 is discharged onto the storage containers 15 supported by the upper conveyor segment 16. The spray nozzles 102 adjacent each gap 5 or 7 can be spaced about the storage system such that their spray patterns overlap. Consequently, the spray nozzles 102 together can provide coverage for all of the storage containers 15 below the gap 5 or 7.

In FIG. 2A, the space above the upper-most storage containers 15 has a height that is much greater than that of the gaps 5 and 7. As a result, the upper-most storage containers 15 can be covered by conventional fire suppression sprinklers (not shown) in addition to, or in place of, the spray nozzles 102 discussed herein. The conventional fire suppression sprinklers can be positioned directly above the storage containers 15. In some examples, the convention fire suppression sprinklers can discharge liquid extinguishant in a circular pattern down onto the upper-most storage containers 15. As shown in FIG. 2A, the upper-most storage containers 15 can optionally be covered by an upper-most set of spray nozzles 102.

Each spray nozzle 102 is configured to receive the liquid extinguishant from a branch line 108, that in turn receives the liquid extinguishant from a feed line 106. Each branch line 108 extends from a feed line 106 along the vertical direction V. Although each feed line 106 is shown above the storage modules 10 and the branch lines 108 are shown as dropping downward from the feed lines 106, it will be understood that the feed lines 106 could be positioned at a base of the storage system, and the branch lines 108 can extend upward from the feed lines 106. Each branch line 108 can extend along the vertical direction V along a select side of the (e.g., 11 or 13 in FIG. 1A) of the storage modules 10. Further, each branch line 108 can extend between adjacent supports 48 along the select side. Thus, each branch line 108 can be in-line with the supports 48 of the select side along the longitudinal direction. In this manner, the branch lines 108 can be routed between laterally adjacent storage modules 10 without a need to increase the distance between the laterally adjacent storage modules 10 to accommodate the branch lines 108.

Turning to FIGS. 3 to 8, a spray nozzle 102 is shown according to one embodiment. In general, the spray nozzle 102 is configured to receive a liquid extinguishant, such as water or a chemical fire retardant, and discharge the liquid extinguishant in a partially-circular spray pattern. The spray nozzle 102 comprises a chamber body 200. The chamber body 200 comprises a first end 202, and a second end 204 that is spaced from the first end 202 along a central axis A that extends along a first direction $D_1$. The first end 202 defines a chamber inlet 206 that is configured to receive a liquid extinguishant along the first direction $D_1$. The first direction $D_1$ can be aligned with the vertical direction V when the spray nozzle 102 is implemented in the fire suppression system 100.

The chamber body 200 has a chamber sidewall 208 that includes an inner side surface 210 and an outer side surface 212. The inner side surface 210 defines a chamber 214 that extends along the central axis A from the chamber inlet 206 towards the second end 204 and terminates before the second end 204. The outer side surface 212 is opposite the inner side surface 210 and extends between the first and second ends 202 and 204 so as to define an outer side perimeter of the chamber body 200. The chamber sidewall 208 defines an outlet slot 216 that extends therethrough such that the outlet slot 216 is open to the inner chamber 214. For example, the outlet slot 216 can extend through both the inner side surface 210 and the outer side surface 212. The outlet slot 216 extends around a portion of the chamber sidewall 208 along a circumferential direction that lies in a plane that is perpendicular to the central axis A. The outlet slot 216 is configured to discharge the liquid extinguishant in the partially-circular spray pattern. Further, the outlet slot 216 is configured to discharge the liquid extinguishant along directions that are substantially perpendicular to the direction of the flow into the chamber inlet 206 (i.e., perpendicular to the first direction $D_1$). This can in turn promote laminar flow through the outlet slot 216.

The chamber 214 can have any suitable shape. In one embodiment, the chamber 214 can have an enlarged region 218 and a tapered region 220 that extends from the enlarged region 218 towards the chamber inlet 206. The enlarged region 218 can have a cross-sectional dimension (e.g., diameter) in a select direction that is perpendicular to the central axis A that is greater than a cross-sectional dimension (e.g., diameter) of the chamber inlet 206 along the select direction. In one example, the enlarged region 218 can have a substantially cylindrical shape. The tapered region 220 can taper inwardly towards the central axis A as it extends from the enlarged region 218 towards the chamber inlet 206. Stated differently, the tapered region 220 can extend outwardly as it extends towards the second end 204. In one example, the tapered region 220 can have a frustoconical shape. The tapered region 220 can allow liquid extinguishant that is received along the first direction $D_1$ to flow radially outwards towards the inner side surface 210. In so doing, the tapered region 220 can help to manage turbulence within the chamber 214 and promote laminar flow to the outlet slot 216.

The chamber body 200 can include a protrusion 222 that extends from second end 204 into the chamber 214. The protrusion 222 can extend into the enlarged region 218 and terminate before the chamber inlet 206, such as before the tapered region 220. The protrusion 222 can be substantially centered about the central axis A. The protrusion 222 can have any suitable shape. In one example, the protrusion 222 can be ramped inwardly as it extends away from the second end 204. For example, the protrusion 222 can have a conical shape with the vertex that is disposed in the chamber 214 at a position that is spaced from the second end 204. The protrusion 222 can be configured to direct liquid extinguishant that is received along the first direction $D_1$ radially outwards towards the inner side surface 210. In so doing, the protrusion 222 can help to manage turbulence within the chamber 214 and promote laminar flow to the outlet slot 216.

The outlet slot 216 can extend around the chamber sidewall 208 by an angle β. The angle β can be any value greater than 0 degrees and up to and including 360 degrees. In some examples, the angle β can be less than or equal to approximately 180 degrees. For example, the outlet slot 216 can extend around the chamber sidewall 208 by less than 180 degrees (i.e., 180 degrees minus an angle θ on each side of the central axis A). The angle θ can be between zero degrees and ten degrees. Thus, the angle β can be in a range that is between 160 degrees and 180 degrees. As shown in FIG. 9, setting the angle β to a value less than 180 degrees when the spray nozzle 102 is positioned laterally outward from the storage containers 15 can prevent the spray nozzle 102 from spraying components that are positioned laterally outward from the storage containers 15 (i.e., components between adjacent spray nozzles 102 with respect to the longitudinal direction L). In one example, the angle θ can be approximately five degrees, such that the outlet slot 216 extends around the chamber sidewall 208 by β=170 degrees.

The outlet slot 216 can be fixedly open, such that the outlet slot 216 does not close. The chamber body 202 can include a pair of opposed interior surfaces 224 that face one another so as to define the outlet slot 216. Each interior surface 224 can extend from the inner side surface 210 to the outer side surface 212. The pair of opposed interior surfaces 224 can be fixed relative to one another with respect to the first direction $D_1$ such that a height between the pair of opposed interior surfaces 224 does not change. In one example, the height between the pair of opposed interior surfaces can be approximately 0.15 inches. Each of the interior surfaces 224 can have the shape of an arc of a circle. Each arc can have a central angle β. In some embodiments, the central angle β can be less than or equal to 180 degrees as described above. In some embodiments, the chamber body 202 can be a one-piece body without any moving parts. In alternative embodiments, the chamber body 202 can be a multi-piece body with or without moving parts, and the outlet slot 216 can be configured to open and close.

At least one of the opposed interior surfaces 224 can be ramped away from the other one of the opposed interior surfaces 224 as they extend along the radial direction. For example, each the opposed interior surfaces 224 can be ramped away from one another as they extend along the radial direction. Thus, the height of the outlet slot 216 can increase along the radial direction. Each interior surface 224 can form an angle α with a plane that is perpendicular to the central axis A. In some examples, the angle α can be between 175 degrees and 180 degrees, such as greater than 179 degrees and less than 180 degrees. In a preferred embodiment, the angle α can be 179.625 degrees. The angle α can be selected to precisely discharge the liquid extinguishant to skim the bottom of the totes at the top of the gap 5 or 7, while having a portion of the spray reach the full radius of the desired spray pattern. Ramping the interior surfaces 224 away from one another can introduce or increase an arc in the spray pattern 250 that reduces the exit velocity of the discharge spray. The volume of the chamber 214 is greater than that of the outlet slot 216. Consequently, the water is pressurized within the chamber 214 before it is discharged out of the outlet slot 216.

The spray nozzle 102 can have a pipe connecting portion 226. The pipe connecting portion 226 can extend from the chamber inlet 206 along the first direction $D_1$ opposite the second end 204. The pipe connecting portion 226 can define a passage 228 therethrough that is open to, and in fluid communication with, the chamber inlet 206. The pipe connecting portion 226 provides the liquid extinguishant to the chamber inlet 206 along the first direction $D_1$. In some embodiments as shown, the pipe connecting portion 226 can be coaxial with the chamber body 200. The pipe connecting portion 226 can define a mechanical fastener 230 that is configured to mate with a mechanical fastener of a pipe or fitting of the supply piping 104. For example, the mechanical fastener 230 can be male threading as shown, a female threading, or any other suitable threading. In some embodiments, the pipe connecting portion 226 can define a smooth surface that is configured to be welded or soldered to a pipe or fitting of the supply piping 104.

It should be noted that the illustrations and descriptions of the embodiments shown in the figures are for exemplary purposes only, and should not be construed limiting the disclosure. One skilled in the art will appreciate that the present disclosure contemplates various embodiments. Additionally, it should be understood that the concepts described above with the above-described embodiments may be employed alone or in combination with any of the other embodiments described above. It should further be appreciated that the various alternative embodiments described above with respect to one illustrated embodiment can apply to all embodiments as described herein, unless otherwise indicated.

Unless explicitly stated otherwise, each numerical value and range should be interpreted as being approximate as if the word "about" or "approximately" preceded the value or range. The terms "about" and "approximately" can be understood as describing a range that is within 15 percent of a specified value.

What is claimed:

1. An inventory storage system, comprising:

at least one storage module that is configured to store inventory items and that comprises:

a first module end and a second module end that are spaced from one another along a longitudinal direction;

an upper conveyor segment and a lower conveyor segment that are spaced from one another along a vertical direction, perpendicular to the longitudinal direction, that each have a length along the longitudinal direction that is greater than a height of the storage module, and that are each configured to move storage containers along the longitudinal direction; and a first connecting conveyor segment and a second connecting conveyor segment that are disposed at the first and second module ends, respectively, and that each connect the upper and lower conveyor segments to one another such that the upper and lower conveyor segments and the first and second connecting conveyor segments together define a movement path having a closed shape, wherein the storage module defines a gap between storage containers supported by the upper conveyor segment and storage containers supported by the lower conveyor segment, and is configured to move storage containers around the movement path until a desired one of the storage containers is presented at one of the first and second module ends; and a fire suppression system comprising at least one spray nozzle that is disposed adjacent to the gap with respect to a lateral direction, perpendicular to both the longitudinal and vertical directions, and that is configured to spray a liquid extinguishant into the gap and onto storage containers supported by the lower conveyor segment.

2. The inventory storage system of claim 1, wherein the at least one storage module comprises at least one vertical stack of the storage modules stacked over one another along the vertical direction so as to define a system gap between adjacent ones of the storage modules in the stack, and the fire suppression system comprises the at least one spray nozzle that is disposed adjacent to the system gap with respect to the lateral direction and that is configured to spray the liquid extinguishant into the system gap and onto storage containers supported below the system gap.

3. The inventory storage system of claim 1, wherein the at least one spray nozzle comprises a plurality of spray nozzles that are disposed adjacent to the gap with respect to the lateral direction, and that are disposed on opposed lateral sides of the storage module such that the plurality of spray nozzles are configured to spray into the storage module from the opposed lateral sides.

4. The inventory storage system of claim 1, wherein the at least one spray nozzle comprises a plurality of spray nozzles that are disposed adjacent to the gap with respect to the lateral direction and that are arranged in a row, wherein the spray nozzles in the row are spaced from one another along the longitudinal direction.

5. The inventory storage system of claim 1, wherein the at least one spray nozzle comprises a chamber body that comprises:

a first end, and a second end that is spaced from the first end along a central axis that extends along a first direction, the first end defining a chamber inlet that is configured to receive the liquid extinguishant along the first direction; and a chamber sidewall comprising:

an inner side surface that defines a chamber that extends along the central axis from the chamber inlet towards the second end and terminates before the second end;

and an outer side surface that is opposite the inner side surface and that extends between the first and second ends so as to define an outer side perimeter of the chamber body, wherein the chamber sidewall defines an outlet slot that extends therethrough such that the outlet slot is open to the chamber, and extends around at least a portion of the chamber sidewall along a circumferential direction, the outlet slot being configured to discharge the liquid extinguishant in a partially-circular spray pattern.

6. The inventory storage system of claim 5, wherein the chamber has:

an enlarged region having a cross-sectional dimension in a select direction that is perpendicular to the central axis that is greater than a cross-sectional dimension of the chamber inlet along the select direction; and a tapered region that extends from the enlarged region towards the chamber inlet and that tapers inwardly towards the central axis as the tapered region extends from the enlarged region towards the chamber inlet.

7. The inventory storage system of claim 6, wherein the chamber body includes a protrusion that extends from the second end into the chamber along the central axis.

8. The inventory storage system of claim 7, wherein the protrusion is ramped inwardly as the protrusion extends from the second end into the chamber so as to be configured to deflect liquid extinguishant outwardly towards the inner side surface.

9. The inventory storage system of claim 5, wherein the chamber body includes a pair of opposed interior surfaces that face one another so as to define the outlet slot, and the pair of opposed interior surfaces are fixed relative to one another with respect to the first direction such that a height between the pair of opposed interior surfaces does not change.

10. A spray nozzle for a fire protection sprinkler system, the spray nozzle comprising:

a first end, and a second end that is spaced from the first end along a central axis that extends along a first direction, the first end defining a chamber inlet that is configured to receive a liquid extinguishant along the first direction, the first end comprising an inner first end surface and an outer first end surface opposite the inner first end surface, and the second end comprising an inner second end surface and an outer second end surface opposite the inner second end surface; and a chamber sidewall comprising:

an inner side surface that defines, with the inner first end surface and the inner second end surface, a chamber that extends along the central axis from the chamber inlet towards the inner second end surface, the inner side surface extends between the first and second ends so as to define an inner side perimeter;

an outer side surface that is opposite the inner side surface and that extends between the first and second ends so as to define an outer side perimeter wherein the chamber sidewall is the same thickness over the inner side and outer side perimeters; and a pair of opposed interior surfaces defining an outlet slot that 1) extends through the chamber sidewall such that the outlet slot is open to the chamber, 2) is elongate around at least a circumferential portion of the chamber sidewall, and 3) is fixedly open, the outlet slot being configured to discharge the liquid extinguishant in a partially-circular spray pattern, wherein the pair of opposed interior surfaces are each between the inner second end surface and the first end.

11. The spray nozzle of claim 10, wherein the chamber has:

an enlarged region having a cross-sectional dimension in a select direction that is perpendicular to the central axis that is greater than a cross-sectional dimension of the chamber inlet along the select direction; and a tapered region that extends from the enlarged region towards the chamber inlet and that tapers inwardly towards the central axis as the tapered region extends from the enlarged region towards the chamber inlet.

12. The spray nozzle of claim 11, wherein the inner second end surface includes a protrusion that extends from the second end into the chamber along the central axis.

13. The spray nozzle of claim 12, wherein the protrusion extends into the enlarged region and terminates before the tapered region.

14. The spray nozzle of claim 12, wherein the protrusion is ramped inwardly as the protrusion extends from the second end into the chamber.

15. The spray nozzle of claim 10, wherein the outlet slot extends circumferentially around the chamber sidewall by an angle that is less than or equal to 180 degrees.

16. The spray nozzle of claim 10, wherein the pair of opposed interior surfaces are fixed relative to one another with respect to the first direction such that a height between the pair of opposed interior surfaces does not change.

17. The spray nozzle of claim 10, wherein at least one of the pair of opposed interior surfaces is ramped away from the other one of the pair of opposed interior surfaces as they extend along a radial direction that is perpendicular to the central axis such that a height of the outlet slot increases as the outlet slot extends along the radial direction.

18. The spray nozzle of claim 10, wherein the first end, the second end, and the chamber sidewall is one-piece without any moving parts.

19. The spray nozzle of claim 10, further comprising a pipe connecting portion that extends from the chamber inlet along a direction that is opposite the second end, and that is configured to mechanically connect to piping of a fire suppression system.

20. The spray nozzle of claim 10, wherein the outlet slot extends circumferentially around the chamber sidewall by an angle that is greater than or equal to 160 degrees.

21. The spray nozzle of claim 19, wherein the pipe connecting portion comprises threading for mechanically connecting to the piping of the fire suppression system.

22. A spray nozzle for a fire protection sprinkler system, the spray nozzle comprising:

a first interior surface defining a chamber inlet in a chamber;

a second interior surface that is spaced from the first interior surface along a first direction, the second interior surface defining a protrusion in the chamber that terminates in a vertex; and a side interior surface defining a pair of opposed interior surfaces of the chamber and defining an outlet slot, the outlet slot extending through and being elongate around at least a circumferential portion of the side interior surface configured to discharge liquid extinguishant in a partially circular spray pattern, wherein the pair of opposed interior surfaces are each between the vertex of the protrusion and the first interior surface wherein the walls defining the pair of opposed interior surfaces are the same width from the bottom of the outlet slot to the second interior surface.

* * * * *